US010991565B2

(12) United States Patent
Fukui

(10) Patent No.: US 10,991,565 B2
(45) Date of Patent: Apr. 27, 2021

(54) ION ANALYZER

(71) Applicant: SHIMADZU CORPORATION, Kyoto (JP)

(72) Inventor: Wataru Fukui, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 18 days.

(21) Appl. No.: 16/062,891

(22) PCT Filed: Dec. 17, 2015

(86) PCT No.: PCT/JP2015/085409
§ 371 (c)(1),
(2) Date: Jun. 15, 2018

(87) PCT Pub. No.: WO2017/104053
PCT Pub. Date: Jun. 22, 2017

(65) Prior Publication Data

US 2018/0374694 A1 Dec. 27, 2018

(51) Int. Cl.
*H01J 49/04* (2006.01)
*H01J 49/16* (2006.01)
(Continued)

(52) U.S. Cl.
CPC ..... *H01J 49/167* (2013.01); *H01J 49/044* (2013.01); *H01J 49/0404* (2013.01);
(Continued)

(58) Field of Classification Search
CPC .. H01J 49/0404; H01J 49/0495; H01J 49/167; H01J 49/24; H01J 49/044;
(Continued)

(56) References Cited

U.S. PATENT DOCUMENTS 2,610,300 A * 9/1952 Walton ..... H01J 49/0495 250/288
2,775,707 A * 12/1956 Benapfl ..... H01J 49/0404 250/288
(Continued)

FOREIGN PATENT DOCUMENTS

CN 101251400 A 8/2008
EP 1 959 242 A2 8/2008
(Continued)

OTHER PUBLICATIONS

Measurement of Xenon Viscosity as a Function of Low Temperature and Pressure Stanley P. Grisnik Lewis Research Center, Cleveland, Ohio (Year: 1998).*
(Continued)

*Primary Examiner* — Sean M Luck
(74) *Attorney, Agent, or Firm* — Sughrue Mion, PLLC

(57) ABSTRACT

Provided is an ion analyzer characterized by: an ionization chamber (10) to be maintained at atmospheric pressure; an analysis chamber (11) for analyzing an ion generated in the ionization chamber (10); a vacuum pump (15, 16) for evacuating the inside of the analysis chamber (11); a capillary (102) for allowing the ionization chamber (10) and the analysis chamber (11) to communicate with each other; a conductance changer (103, 104) for changing the conductance of the capillary (102); and a controller (20) for operating the conductance changer (103, 104) in such a manner as to decrease the conductance of the capillary (102) when the degree of vacuum in the analysis chamber (11) is lower than a predetermined degree of vacuum.

7 Claims, 2 Drawing Sheets

(51) Int. Cl.

| | |
|---|---|
| ***H01J 49/24*** | (2006.01) |
| ***H01J 49/14*** | (2006.01) |
| ***H01J 49/26*** | (2006.01) |
| *H01J 49/06* | (2006.01) |

(52) U.S. Cl.
CPC ..... *H01J 49/0495* (2013.01); *H01J 49/14* (2013.01); *H01J 49/24* (2013.01); *H01J 49/26* (2013.01); *H01J 49/049* (2013.01); *H01J 49/063* (2013.01)

(58) Field of Classification Search
CPC ..... H01J 49/14; H01J 49/26; H01J 49/049; H01J 49/063
See application file for complete search history.

(56) References Cited

U.S. PATENT DOCUMENTS

| | | | | |
|---|---|---|---|---|
| 3,440,417 | A * | 4/1969 | Heath | H01J 49/0409 250/288 |
| 4,018,241 | A * | 4/1977 | Sodal | H01J 49/0495 137/14 |
| 4,201,913 | A * | 5/1980 | Bursack | H01J 49/0422 250/288 |
| 6,568,799 | B1 * | 5/2003 | Yang | B41J 2/14 347/85 |
| 6,982,416 | B2 * | 1/2006 | Villinger | H01J 49/145 250/281 |
| 7,159,618 | B2 * | 1/2007 | Broyer | F15C 5/00 137/807 |
| 2003/0106596 | A1 * | 6/2003 | Yang | F15C 5/00 137/828 |
| 2008/0196493 | A1 | 8/2008 | Anzai et al. | |
| 2010/0078553 | A1 * | 4/2010 | Corso | H01J 49/0404 250/288 |
| 2010/0200746 | A1 * | 8/2010 | Osgood | C07B 63/00 250/282 |
| 2010/0301209 | A1 | 12/2010 | Ouyang et al. | |
| 2012/0112061 | A1 * | 5/2012 | Morokuma | H01J 49/0031 250/288 |
| 2013/0056633 | A1 | 3/2013 | Hashimoto et al. | |
| 2013/0146759 | A1 | 6/2013 | Ouyang et al. | |
| 2013/0320207 | A1 * | 12/2013 | Morokuma | H01J 49/0495 250/288 |
| 2017/0140912 | A1 * | 5/2017 | Ouyang | H01J 49/04 |
| 2017/0210493 | A1 * | 7/2017 | Marchandise | B64G 1/405 |
| 2018/0374694 | A1 * | 12/2018 | Fukui | H01J 49/0404 |

FOREIGN PATENT DOCUMENTS

| | | | |
|---|---|---|---|
| JP | 2-110859 | U | 9/1990 |
| JP | 8-166500 | A | 6/1996 |
| JP | 2006-208334 | A | 8/2006 |
| JP | 2008-233073 | A | 10/2008 |
| JP | 4816426 | B2 | 11/2011 |
| JP | 2013-105737 | A | 5/2013 |
| JP | 2015-049077 | A | 3/2015 |
| JP | 2015-198014 | A | 11/2015 |
| WO | 2009/031179 | A1 | 3/2009 |

OTHER PUBLICATIONS

Extended European Search Report dated Nov. 28, 2018 issued by the European Patent Office in counterpart application No. 15910743.2.

International Search Report for PCT/JP2015/085409 dated Feb. 23, 2016 (PCT/ISA/237).

* cited by examiner

ION ANALYZER

CROSS REFERENCE TO RELATED APPLICATIONS

This application is a National Stage of International Application No. PCT/JP2015/085409 filed Dec. 17, 2015.

TECHNICAL FIELD

The present invention relates to an ion analyzer, such as a mass spectrometer, including an ionization chamber which is used at atmospheric pressure and an analysis chamber in which an ion generated in the ionization chamber is analyzed under vacuum, with the analysis chamber communicating with the ionization chamber through a capillary.

BACKGROUND ART

Ion sources used in mass spectrometers can be divided into two major types: an ion source which ionizes a sample under atmospheric pressure (atmospheric pressure ion source), and an ion source which ionizes a sample under vacuum. Atmospheric pressure ion sources have been popularly used since they do not require the task of evacuating the ionization chamber and is therefore easy to handle.

FIG. 1 shows a schematic configuration of a mass spectrometer having an atmospheric pressure ion source 501. This mass spectrometer includes an ionization chamber 50 which is maintained at atmospheric pressure and an analysis chamber 51 which communicates with the ionization chamber 50 through a capillary 502 and yet should be maintained in a vacuum state. The analysis chamber 51 has the configuration of a multi-stage differential pumping system which includes a first intermediate vacuum chamber 52 maintained in a low-vacuum state by a rotary pump, as well as a second intermediate vacuum chamber 53 and a mass spectrometry chamber 54 maintained in a high-vacuum state by a turbo molecular pump, with the degree of vacuum increased in a stepwise manner toward the rear side (for example, see Patent Literature 1).

CITATION LIST

Patent Literature

Patent Literature 1: JP 2015-198014 A
Patent Literature 2: JP 2015-49077 A
Patent Literature 3: JP 4816426 B

SUMMARY OF INVENTION

Technical Problem

Before the mass spectrometer is started up, the analysis chamber 51 is open to the atmosphere. In order to make the transition from this state to a state in which mass spectrometry can be performed, it is necessary to evacuate the inside of the analysis chamber 51 with a vacuum pump until a desired degree of vacuum is achieved within the analysis chamber 51. The operation of evacuating the analysis chamber 51 from the atmospheric state causes a greater amount of load on the vacuum pump than the operation of maintaining the degree of vacuum in the analysis chamber 51 which has achieved the desired degree of vacuum. The longer the evacuation time is, the shorter the life of the vacuum pump becomes, and the higher the cost for the replacement or repair becomes.

Although a mass spectrometer is used as a specific example in the previous description, the problem that an increase in the period of time of a high-load evacuating operation shortens the life of a vacuum pump and increases the cost for the replacement or repair can similarly occur in other types of ion analyzers, such as an ion mobility spectrometer, including an ionization chamber which has an atmospheric pressure ion source and an analysis chamber in which an ion generated in the ionization chamber is analyzed under vacuum, with the analysis chamber communicating with the ionization chamber through a capillary, as with the mass spectrometer.

The problem to be solved by the present invention is to reduce the load on the vacuum pump used for evacuating the analysis chamber in an ion analyzer including an ionization chamber which is used at atmospheric pressure and an analysis chamber in which an ion generated in the ionization chamber is analyzed under vacuum, with the analysis chamber communicating with the ionization chamber through a capillary.

Solution to Problem

The ion analyzer according to the present invention developed for solving the previously described problem includes:

a) an ionization chamber to be maintained at atmospheric pressure;

b) an analysis chamber configured to analyze an ion generated in the ionization chamber;

c) a vacuum pump configured to evacuate the inside of the analysis chamber;

d) a capillary configured to allow the ionization chamber and the analysis chamber to communicate with each other;

e) a conductance changer configured to change the conductance of the capillary; and f) a controller configured to operate the conductance changer in such a manner as to decrease the conductance of the capillary when the degree of vacuum in the analysis chamber is lower than a predetermined degree of vacuum.

The ion analyzer according to the present invention includes a conductance changer configured to change the conductance of the capillary, and a controller configured to operate the conductance changer in such a manner as to decrease the conductance of the capillary when the degree of vacuum in the analysis chamber is lower than a predetermined degree of vacuum. Accordingly, for example, during the startup process of the ion analyzer, the conductance of the capillary can be decreased (the resistance of the capillary can be increased) by the conductance changer to reduce the amount of air flowing from the ionization chamber into the analysis chamber so as to shorten the evacuation time of the vacuum pump and reduce the load on the pump.

The conductance changer can be embodied based on the following idea:

With D (m) denoting the inner diameter of the capillary, L (m) denoting the length of the capillary, and P (Pa) denoting the pressure difference between the inlet and outlet ends of the capillary, the conductance C ($m^3/s$) of the capillary (the degree of ease of the flow of gas with viscosity coefficient 11) is expressed by Knudsen's approximate equation as follows:

$$C = \frac{\pi}{128}\frac{D^4}{\eta L}P \quad (1)$$

Equation (1) demonstrates that conductance C can be decreased by increasing the viscosity coefficient η of the gas. In the case of air, heating the air from 20 to 300 degrees Celsius increases its viscosity coefficient η to 1.6 times, which decreases the conductance by approximately 40%.

Accordingly, for example, a heating mechanism for heating the capillary can be used as the conductance changer. With this mechanism, the air flowing through the capillary can be heated to decrease the conductance of the capillary.

After the desired degree of vacuum has been achieved within the analysis chamber, when an analysis of ions is performed, the heating of the capillary can be discontinued to increase the conductance and enhance the efficiency of the introduction of the sample.

If the ion analyzer includes an atmospheric pressure ion source for ionizing a liquid sample (such as an ESI probe or APCI probe), it is possible to use, as the conductance changer, a heating-gas supply mechanism which supplies, into the ionization chamber, a heating gas for desorbing solvent molecules from electrically charged droplets originating from the liquid sample. Such a mechanism is normally included in an atmospheric pressure ion source. This heating gas is usually sprayed onto the charged particles only in the process of ionizing a target sample. In one mode of the ion analyzer according to the present invention, this heating gas is used in the startup process of the ion analyzer. For example, consider the case of supplying a heating gas of 400 degrees Celsius into the ionization chamber. Although this gas is slightly cooled within the ionization chamber (e.g. to approximately 300 degrees Celsius), the gas flowing into the capillary has a higher degree of viscosity than the same gas at room temperature, whereby the conductance is decreased. In this manner, an existing component of the device can be utilized for changing the conductance.

Advantageous Effects of the Invention

With the ion analyzer according to the present invention, the load on the vacuum pump used for evacuating the analysis chamber in the ion analyzer can be reduced.

DESCRIPTION OF EMBODIMENTS

Figure 1:
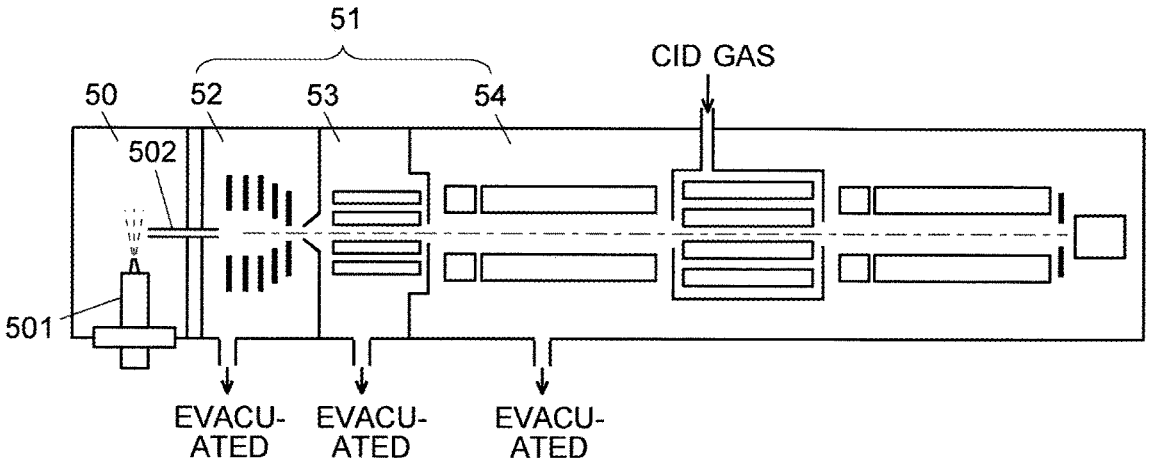
FIG. 1 is a configuration diagram of the main components of a mass spectrometer.
Figure 2:
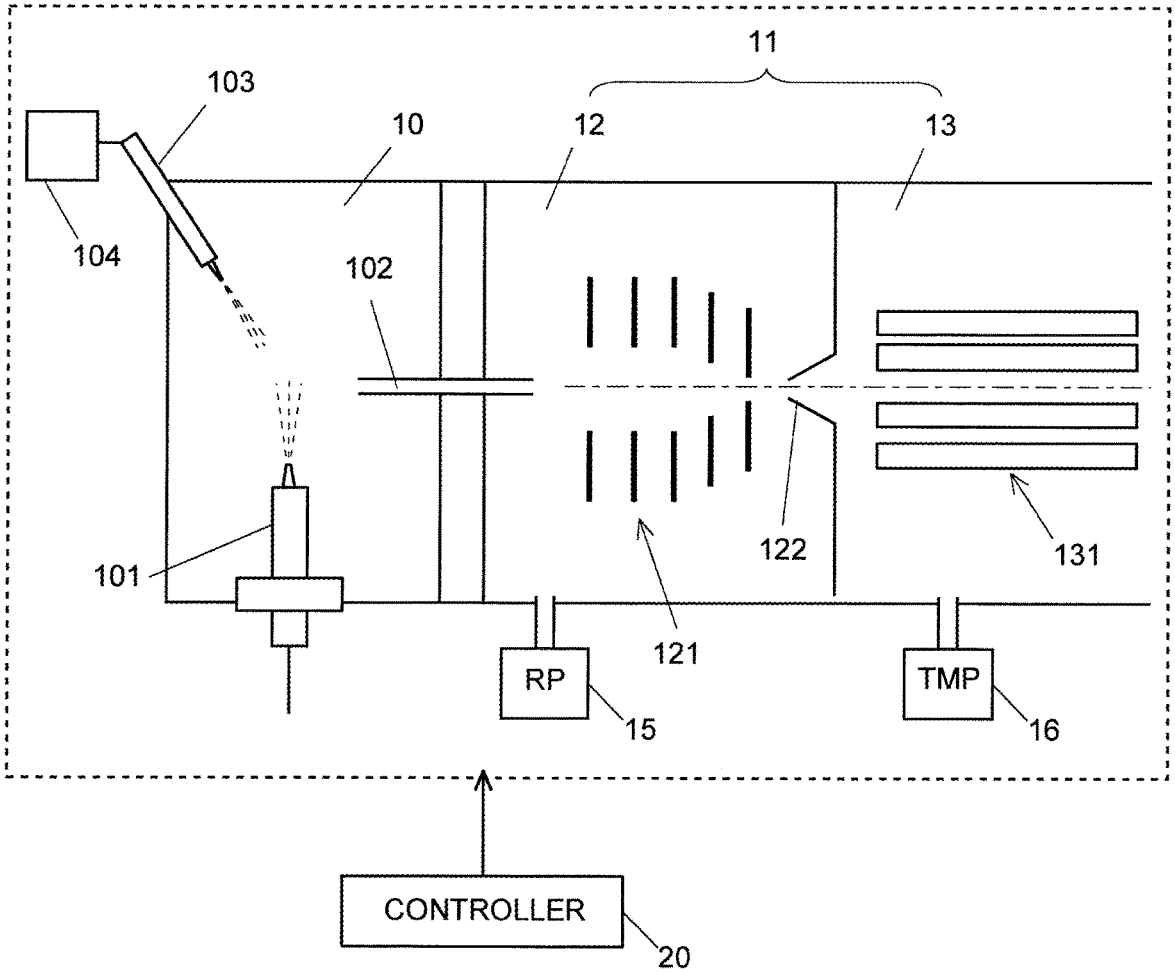
FIG. 2 is a configuration diagram of the main components of an interface section in one embodiment of a mass spectrometer according the present invention.

A mass spectrometer as one embodiment of the ion analyzer according to the present invention is hereinafter described with reference to the drawings. The configuration of the rear section of the analysis chamber 11 in the present embodiment is the same as in the conventional mass spectrometer described earlier with reference to FIG. 1. Accordingly, the rear section is omitted from FIG. 2 which shows an enlarged view of an interface section (the ionization chamber 10 and the front section of the analysis chamber 11) which is the characteristic section of the present embodiment. An operation of this section is hereinafter described.

The mass spectrometer in the present embodiment includes an ionization chamber 10 maintained at substantially atmospheric pressure and an analysis chamber 11 evacuated by vacuum pumps. The analysis chamber 11 has the configuration of a multistage differential pumping system including a first intermediate vacuum chamber 12, second intermediate vacuum chamber 13 and mass spectrometry chamber (not shown) arranged in the mentioned order from the ionization chamber 10, with their degrees of vacuum increased in a stepwise manner in the same order.

The first intermediate vacuum chamber 12 is maintained in a low-vacuum state by being evacuated by a rotary pump (RP). The ionization chamber 10 is provided with an ESI (electrospray ionization) probe 101, which is an atmospheric pressure ion source for ionizing a liquid sample, and a heating-gas supply tube 103. The ionization chamber 10 communicates with the first intermediate vacuum chamber 12 through a capillary 102 with a small diameter. A liquid sample introduced into the ESI probe 101 is given electric charges as well as atomized by nebulizer gas, to be sprayed into the ionization chamber 10 in the form of fine charged droplets. The charged droplets sprayed into the ionization chamber 10 are drawn into the first intermediate vacuum chamber 12 due to the pressure difference between the ionization chamber 10 at atmospheric pressure and the first intermediate vacuum chamber 12 in the low-vacuum state. The heating-gas supply tube 103 is a tube for supplying a heating gas from the heating-gas source 104 into the ionization chamber 10. This gas causes the desorption of the solvent molecules from the charged droplets moving from the ESI probe 101 toward the inlet of the capillary 102.

The first intermediate vacuum chamber 12 is separated from the second intermediate vacuum chamber 13 by a skimmer 22 having a small hole at its apex. The first and second intermediate vacuum chambers 12 and 13 respectively contain ion guides 121 and 131 for transporting ions to the subsequent stage while converging those ions. The second intermediate vacuum chamber 13 and the mass spectrometry chamber (not shown) are maintained in a high-vacuum state by a turbo molecular pump (TMP) 16.

The operations of the previously described sections are controlled by a controller 20. Among the control operations by the controller 20, the control of the startup process which is characteristic of the present embodiment is hereinafter described.

Before the mass spectrometer is started up, the ionization chamber 10 and the analysis chamber 11 are open to the atmosphere. Accordingly, in order to make the transition to a state in which mass spectrometry can be performed, the analysis chamber 11 should initially be evacuated. The evacuation of the analysis chamber 11 is achieved by initially evacuating the analysis chamber 11 to a low-vacuum state by the rotary pump 15 connected to the first intermediate vacuum chamber 12, and subsequently evacuating the second intermediate vacuum chamber 13 and the mass spectrometry chamber to a high-vacuum state by the turbo molecular pump 16.

In parallel with the startup of the rotary pump 15, the controller 20 of the mass spectrometer in the present embodiment initiates the supply of an inert gas (e.g. nitrogen gas) heated to approximately 400 degrees Celsius from the heating-gas source 104. This gas is supplied through the heating-gas supply tube 103 into the ionization chamber 10. Although the heating gas supplied into the ionization chamber 10 is slightly cooled within the ionization chamber 10 (e.g. to 300 degrees Celsius), the gas flowing from the ionization chamber 10 into the capillary 102 has a higher degree of viscosity than the same gas at room temperature, whereby the conductance is decreased. The heating of the capillary 102 does not need to be initiated at exactly the same time as the startup of the rotary pump 15. A slight difference in time is permissible.

When the evacuation of the analysis chamber 11 is initiated, a pressure difference occurs between the ionization chamber 10 maintained at atmospheric pressure and the analysis chamber 11. Consequently, a flow of air is generated from the ionization chamber 10 into the first intermediate vacuum chamber 12 through the capillary 102. The conductance of the capillary 102 is expressed by the following equation (1):

$$C = \frac{\pi}{128}\frac{D^4}{\eta L}P \tag{1}$$

In the mass spectrometer according to the present embodiment, since the capillary 102 is heated in parallel with the startup of the rotary pump 15, the air in the vicinity of the capillary 102 as well as the air passing through the capillary 102 are also heated. For example, if the air is heated from 20 degrees Celsius to 300 degrees Celsius, its viscosity coefficient increases to 1.6 times. Equation (1) demonstrates that this increase in the viscosity coefficient decreases the conductance to approximately 0.63 times, which causes a corresponding decrease in the amount of air flowing from the ionization chamber 10 into the first intermediate vacuum chamber 12 through the capillary 102. In the mass spectrometer according to the present embodiment, the amount of air flowing into the first intermediate vacuum chamber 12 is decreased in this manner, and the period of time for evacuating the analysis chamber 11 is thereby shortened. Consequently, the load on the rotary pump 15 is reduced.

After the analysis chamber 11 has been evacuated to a predetermined degree of vacuum by the rotary pump 15, the second intermediate vacuum chamber 13 and the mass spectrometry chamber are evacuated by the turbo molecular pump 16. This operation is also performed with the reduced amount of air flowing from the ionization chamber 10 through the first intermediate vacuum chamber 12 into the second intermediate vacuum chamber 13. Therefore, the period of time for evacuating the second intermediate vacuum chamber 13 and the mass spectrometry chamber to a predetermined degree of vacuum (high vacuum) by the turbo molecular pump 16 is shortened. Consequently, the load on the turbo molecular pump 16 is also reduced.

Thus, in the mass spectrometer according to the present embodiment, the load on both the rotary pump 15 and the turbo molecular pump 16 provided for evacuating the analysis chamber 11 is reduced. Therefore, the life of those pumps will be longer, and the running cost of the device will be lower. Furthermore, in the mass spectrometer according to the present embodiment, a heating-gas supply mechanism including the heating-gas supply tube 103 and the heating-gas source 104 which have conventionally been used for ionizing a liquid sample (i.e. which have been used only during an analysis of a real sample) is utilized as the conductance changer in the startup process of the mass spectrometer. Therefore, the device can be inexpensively constructed without requiring any special component to be newly added.

Although the previous embodiment is concerned with the case of a mass spectrometer including an ESI probe 101 for ionizing a liquid sample under atmospheric pressure, a mass spectrometer including an APCI (atmospheric pressure chemical ionization) probe can also be configured as in the previous embodiment. Additionally, although the previous embodiment is concerned with the case of a device in which the ESI probe 101 and the heating-gas supply mechanism are separated from each other, the present invention can also be applied in a device including the heating-gas supply tube disposed around the ESI probe 101 in an integrated fashion (for example, see Patent Literature 2).

Some types of ion sources do not have a heating-gas supply tube 103. In such a case, the previously described effect can similarly be obtained by providing a heating mechanism for directly heating the capillary 102. Needless to say, such a heating mechanism may additionally be introduced into a mass spectrometer having the heating-gas supply tube 103.

Figure 3:
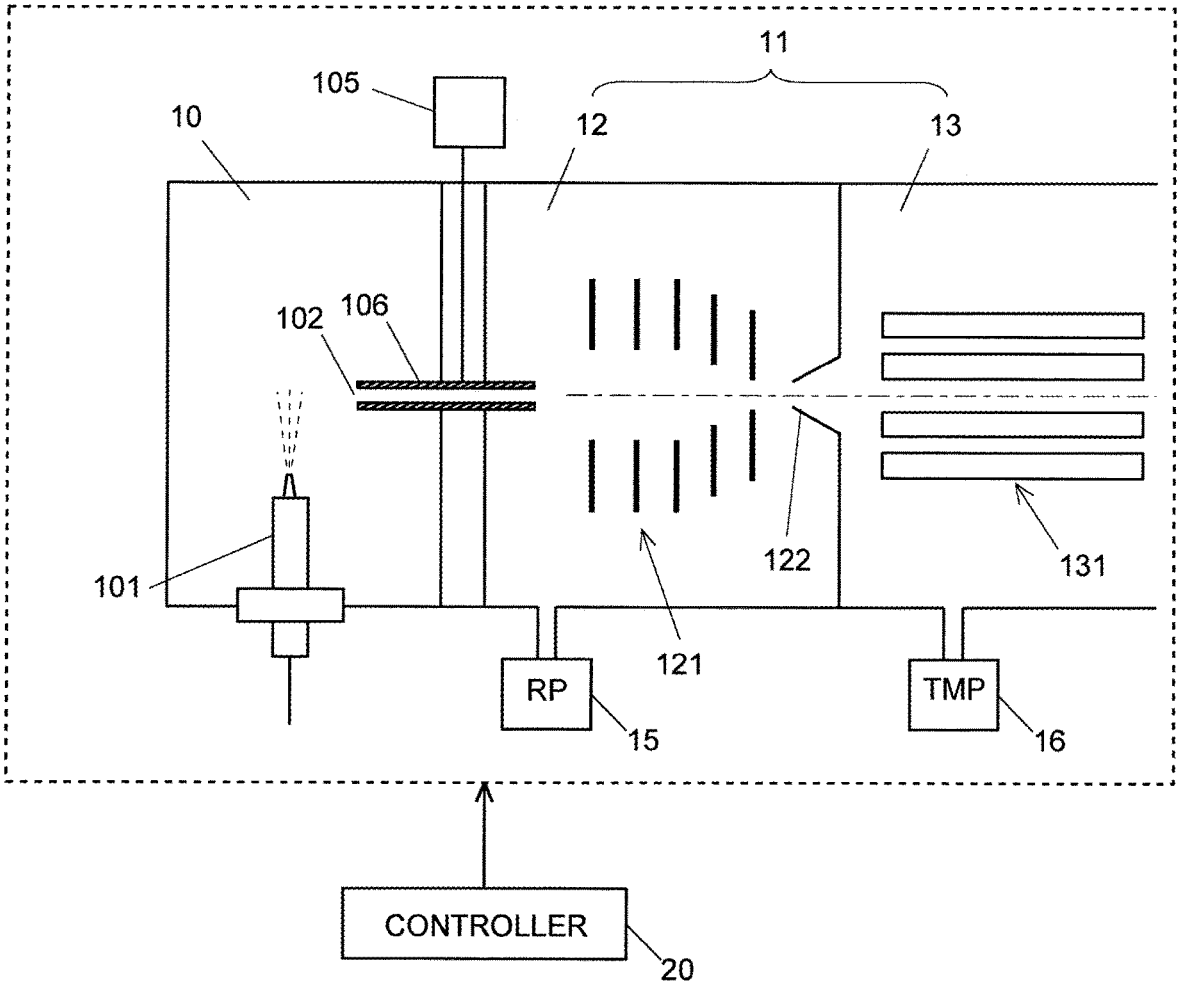
FIG. 3 is a configuration diagram of the main components of an interface section in another embodiment of a mass spectrometer according the present invention.

For example, as shown in FIG. 3, the heating mechanism may include a heater 106 wound around the capillary 102 and a power source 105 for supplying electric current to the heater 106. A configuration described in Patent Literature 3 may also be used to heat the capillary. Any of these mechanisms may preferably employ a temperature sensor to allow for the measurement of the temperature of the capillary 102.

Figure 4:
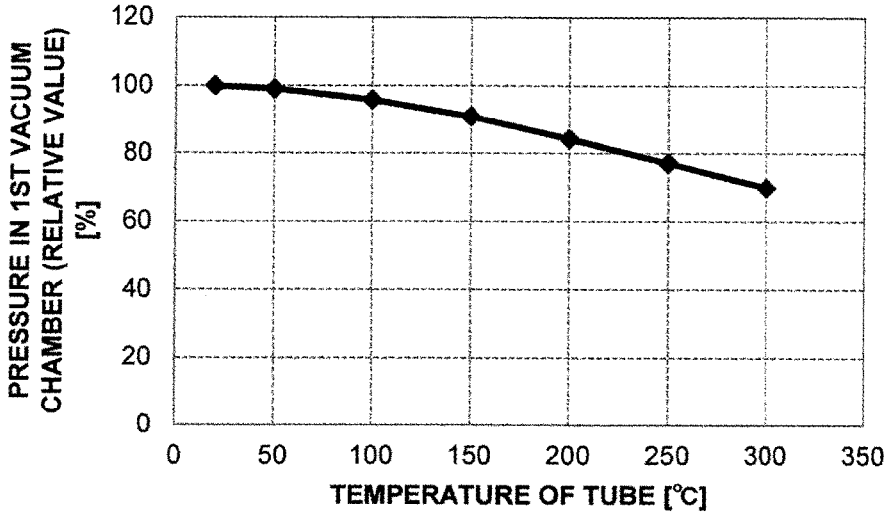
FIG. 4 is a graph showing the correlation between the temperature of the capillary and the degree of vacuum of the first intermediate vacuum chamber.

The correlation between the temperature of the capillary 102 and the degree of vacuum in the first intermediate vacuum chamber 12 has been experimentally investigated to confirm the effect obtained by the configuration of the previous embodiment. The measured result is shown in FIG. 4. FIG. 4 graphically shows the relative pressure in the first intermediate vacuum chamber 12 at each temperature, where the pressure observed when the temperature of the capillary 102 was 20 degrees Celsius is defined as 100(%). It can be understood from FIG. 4 that the pressure in the first intermediate vacuum chamber 12 becomes lower (and the degree of vacuum becomes higher) with an increase in the temperature of the capillary 102.

The previous embodiment is a mere example of the present invention and can be appropriately changed without departing from the spirit of the present invention. Although the previous embodiment is concerned with a mass spectrometer, a similar configuration to the previous embodiment can also be applied in an ion mobility spectrometer or other types of analyzers which uses an atmospheric ionization chamber and an evacuated analysis chamber communicating with each other.

The previous embodiment is concerned with the case of heating the capillary 102 in the startup process of the mass spectrometer (by increasing the temperature of the capillary 102 with an inflow of the heating gas, or by directly heating the capillary). The operation of heating the capillary 102 to decrease the amount of air flowing from the ionization chamber 10 into the analysis chamber 11 may also be performed when the evacuation capacity has lowered in the middle of an analysis of a real sample due to a problem with the rotary pump 15 or turbo molecular pump 16 (i.e. when the degree of vacuum in the analysis chamber 11 has become lower than a predetermined degree of vacuum). By this operation, the degree of vacuum in the analysis chamber 11 is prevented rapid deterioration, and a certain degree of vacuum is maintained until the completion of the ongoing analysis.

In the previous embodiment, the conductance of the capillary 102 is decreased by lowering the viscosity coefficient η of the air by heating the capillary 102. Other methods may be used to decrease the conductance of the capillary 102. As a specific example, an expandable capillary may be used, in which case the conductance can be decreased by increasing the length L of the capillary 102 when the degree of vacuum in the analysis chamber 11 is lower than a predetermined degree of vacuum (e.g. during the startup process of the mass spectrometer). A capillary 102 with a variable inner diameter may also be used, in which case the conductance can be decreased by decreasing the inner diameter of the capillary 102 when the degree of vacuum in the analysis chamber 11 is lower than a predetermined degree of vacuum.

REFERENCE SIGNS LIST

10 . . . Ionization Chamber
101 . . . ESI Probe
102 . . . Capillary
103 . . . Heating-Gas Supply Tube
104 . . . Heating-Gas Source
105 . . . Power Source
106 . . . Heater
107 . . . Temperature Sensor
11 . . . Analysis Chamber
12 . . . First Intermediate Vacuum Chamber
121 . . . Ion Guide
13 . . . Second Intermediate Vacuum Chamber
131 . . . Ion Guide
15 . . . Rotary Pump
16 . . . Turbo Molecular Pump
20 . . . Controller

The invention claimed is:

1. An ion analyzer, comprising:

a) an ionization chamber to be maintained at atmospheric pressure;

b) an analysis chamber configured to analyze an ion generated in the ionization chamber;

c) a vacuum pump configured to evacuate an inside of the analysis chamber;

d) a capillary configured to allow the ionization chamber and the analysis chamber to communicate with each other;

e) a conductance changer that is a heater configured to heat the capillary, or is a heating-gas supply mechanism configured to supply a heating gas into the ionization chamber, the conductance changer configured to decrease a conductance of the capillary by adding heat, while keeping a state in which the analysis chamber is communicating with the ionization chamber through the capillary; and f) a controller configured to operate the conductance changer during a time period of starting up the ion analyzer in such a manner as to decrease the conductance of the capillary by controlling the conductance changer to add the heat when a degree of vacuum in the analysis chamber is lower than a predetermined degree of vacuum.

2. The ion analyzer according to claim 1, wherein the controller is configured to operate the conductance changer to decrease the conductance of the capillary by adding the heat while the analysis chamber is evacuated from atmospheric pressure to the predetermined degree of vacuum.

3. The ion analyzer according to claim 1, wherein the conductance changer is the heater.

4. The ion analyzer according to claim 1, wherein the conductance changer is the heating-gas supply mechanism.

5. The ion analyzer according to claim 1, wherein the controller is configured to, in parallel with the vacuum pump evacuating the inside of the analysis chamber during the time period of starting up the ion analyzer, operate the conductance changer in the manner to decrease the conductance of the capillary by controlling the conductance changer to add the heat when the degree of vacuum in the analysis chamber is lower than the predetermined degree of vacuum.

6. The ion analyzer according to claim 5, wherein the conductance changer is the heating-gas supply mechanism, and the controller is configured to, during the time period of starting up the ion analyzer, cause the heating-gas supply mechanism to operate in a first mode, where the heating-gas supply mechanism heats the heating-gas supplied to the ionization chamber such that the conductance of the capillary, with respect to the heating-gas, is decreased when the degree of vacuum in the analysis chamber is lower than the predetermined degree of vacuum.

7. The ion analyzer according to claim 6, wherein the heating-gas supply mechanism is configured to operate in a second mode where the heating-gas supply mechanism supplies the heating-gas such that the heating gas ionizes a sample to generate the ion in the ionization chamber.

* * * * *